US010220532B2

(12) United States Patent
Davos et al.

(10) Patent No.: US 10,220,532 B2
(45) **Date of Patent: *Mar. 5, 2019**

(54) RAZOR BLADE, RAZOR HEAD, AND METHOD OF MANUFACTURE

(71) Applicant: BIC-VIOLEX S.A., Anixi (GR)

(72) Inventors: Vasileios Davos, Ilion (GR); Vassilis Papachristos, Athens (GR); Dimitrios Efthimiadis, Nea Kypseli (GR); Panagiotis Zafiropoulos, Wallingford, CT (US); Nikolaos Skounakis, Perissos (GR); Ioannis Komianos, Peristeri (GR); Michalis Karoussis, Athens (GR); Anastasios Papageorgiou, Peristeri (GR)

(73) Assignee: BIC VIOLEX SA, Anixi (GR)

( * ) Notice: Subject to any disclaimer, the term of this patent is extended or adjusted under 35 U.S.C. 154(b) by 0 days.

This patent is subject to a terminal disclaimer.

(21) Appl. No.: 15/804,051

(22) Filed: Nov. 6, 2017

(65) Prior Publication Data

US 2018/0065262 A1 Mar. 8, 2018

Related U.S. Application Data

(62) Division of application No. 14/348,839, filed as application No. PCT/EP2012/069883 on Oct. 8, 2012, now Pat. No. 9,862,108.

(30) Foreign Application Priority Data

Oct. 6, 2011 (WO) ..... PCT/EP2011/067451

(51) Int. Cl.
*B26B 21/58* (2006.01)
*B26B 21/56* (2006.01)
(Continued)

(52) U.S. Cl.
CPC ..... *B26B 21/14* (2013.01); *B26B 21/4031* (2013.01); *B26B 21/4068* (2013.01);
(Continued)

(58) Field of Classification Search
CPC ... Y10T 225/10; B26B 21/14; B26B 21/4031; B26B 21/4068; B26B 21/58; B26B 21/565
See application file for complete search history.

(56) References Cited

U.S. PATENT DOCUMENTS 2,674,039 A 5/1954 Bueno de Mesquita
3,425,877 A 2/1969 Deacon et al.
(Continued)

FOREIGN PATENT DOCUMENTS

CN 1812856 A 8/2006
CN 1929972 A 3/2007
(Continued)

OTHER PUBLICATIONS

International Union of Pure and Applied Chemistry: Compendium of Chemical Terminology Gold Book; Version 2.3.3, Feb. 24, 2014.
(Continued)

*Primary Examiner* — Hwei-Siu C Payer
(74) *Attorney, Agent, or Firm* — Polsinelli PC

(57) ABSTRACT

An integrally formed rigid razor blade made of martensitic stainless steel includes a cutting edge portion, a base portion, and a bent portion. The cutting edge portion extends along a cutting edge portion axis and has a cutting edge at one end. The base portion extends along a base portion axis. The bent portion is intermediate the cutting edge portion and the base portion. The blade has a concave face and an opposed convex face. An average radius of curvature of the concave face of the bent portion is between 0.5 millimeters and 1 millimeters.

8 Claims, 8 Drawing Sheets

(51) Int. Cl.
*B26B 21/14* (2006.01)
*B26B 21/40* (2006.01)

(52) U.S. Cl.
CPC ..... *B26B 21/565* (2013.01); *B26B 21/58* (2013.01); *Y10T 225/10* (2015.04)

(56) References Cited

U.S. PATENT DOCUMENTS

| | | | |
|---|---|---|---|
| 3,748,568 | A | 7/1973 | Ackermann |
| 3,835,537 | A | 9/1974 | Sastri |
| 4,180,420 | A | 12/1979 | Sastri et al. |
| 4,287,007 | A | 9/1981 | Vander Voort |
| 4,302,876 | A | 12/1981 | Emmett |
| 4,378,634 | A | 4/1983 | Jacobson |
| 4,389,773 | A | 6/1983 | Nissen et al. |
| 4,498,235 | A | 2/1985 | Jacobson |
| 4,621,424 | A | 11/1986 | Jacobson |
| 5,010,646 | A | 4/1991 | Neamtu |
| 5,275,672 | A | 1/1994 | Athaus et al. |
| 5,305,526 | A | 4/1994 | Althaus |
| 5,369,885 | A | 12/1994 | Ferraro |
| 5,701,788 | A | 12/1997 | Wilson et al. |
| 5,823,082 | A | 10/1998 | Wilson et al. |
| 6,009,624 | A | 1/2000 | Apprille, Jr. et al. |
| 6,629,475 | B1 | 10/2003 | Neamtu et al. |
| 6,804,886 | B2 | 10/2004 | Wain |
| 7,100,284 | B2 | 9/2006 | King |
| 7,131,202 | B2 | 11/2006 | Pennell et al. |
| 7,531,052 | B2 | 5/2009 | Yoshiyama |
| 7,758,707 | B2 | 7/2010 | Millward |
| 8,347,512 | B2 | 1/2013 | Masek et al. |
| 8,359,752 | B2 * | 1/2013 | Bridges ..... B26B 21/222 30/50 |
| 8,499,462 | B2 | 8/2013 | Masek et al. |
| 9,789,618 | B2 * | 10/2017 | Bozikis ..... B26B 21/4031 |
| 9,862,108 | B2 * | 1/2018 | Davos ..... B26B 21/14 |
| 2007/0124939 | A1 | 6/2007 | Van Eibergen Santhagens |
| 2007/0234576 | A1 | 10/2007 | Masek et al. |
| 2007/0234577 | A1 | 10/2007 | Masek et al. |
| 2007/0274855 | A1 | 11/2007 | Nilsson |
| 2008/0022530 | A1 | 1/2008 | Royle |
| 2009/0193659 | A1 | 8/2009 | Park et al. |
| 2010/0077618 | A1 | 4/2010 | Peterson |
| 2010/0107425 | A1 | 5/2010 | Bykowski et al. |
| 2011/0162209 | A1 | 7/2011 | Wain |
| 2011/0232100 | A1 | 9/2011 | Park et al. |
| 2011/0289779 | A1 | 12/2011 | Volodin et al. |
| 2011/0314678 | A1 | 12/2011 | Peterson |
| 2014/0230252 | A1 | 8/2014 | Davos et al. |
| 2014/0283387 | A1 | 9/2014 | Bozikis et al. |
| 2016/0361828 | A1 | 12/2016 | Xu et al. |
| 2018/0009123 | A1 * | 1/2018 | Davos ..... B26B 21/565 |
| 2018/0065262 | A1 * | 3/2018 | Davos ..... B26B 21/4068 |
| 2018/0065263 | A1 * | 3/2018 | Davos ..... B26B 21/4068 |

FOREIGN PATENT DOCUMENTS

| | | | |
|---|---|---|---|
| EP | 1 011 934 | B1 | 5/2002 |
| EP | 1 739 199 | A1 | 1/2007 |
| EP | 1 644 146 | B2 | 10/2010 |
| EP | 2 203 282 | B1 | 11/2011 |
| JP | 02-147120 | | 6/1990 |
| JP | 6-145907 | | 5/1994 |
| JP | 7-116733 | A | 5/1995 |
| JP | 2004-098078 | | 4/2004 |
| JP | 2005-177790 | A | 7/2005 |
| JP | 2006-75453 | A | 3/2006 |
| WO | 85/02809 | A1 | 7/1985 |
| WO | 91/19596 | A1 | 12/1991 |
| WO | 98/18604 | A1 | 5/1998 |
| WO | 01/34352 | A2 | 5/2001 |
| WO | 2004/112986 | A1 | 12/2004 |
| WO | 2006/027018 | A1 | 3/2006 |
| WO | 2007/147420 | A1 | 12/2007 |
| WO | 2008/002069 | A1 | 1/2008 |
| WO | 2009/058437 | A1 | 5/2009 |
| WO | 2009/137389 | A1 | 11/2009 |
| WO | 2010/006654 | A1 | 1/2010 |
| WO | 2011/008851 | A2 | 1/2011 |
| WO | 2011/062760 | A1 | 5/2011 |
| WO | WO 2013/050606 | A1 * | 4/2013 |

OTHER PUBLICATIONS

Modern Analytical Chemistry 2.0; Chapter 3: The Vocabulary of Analytical Chemistry; By: David Harvey; Feb. 15, 2008.

* cited by examiner

RAZOR BLADE, RAZOR HEAD, AND METHOD OF MANUFACTURE

CROSS REFERENCE TO RELATED APPLICATION

This application is a continuation of U.S. application Ser. No. 14/348,839, filed Mar. 31, 2014, now U.S Pat. No. 9,862,108, which is a national stage application of International Application No. PCT/EP2012/069883, filed on Oct. 8, 2012, which claims the benefit of International Application No. PCT/EP2011/067451 filed on Oct. 6, 2011, the entire contents are hereby incorporated herein by reference.

FIELD OF THE INVENTION

The embodiments of the present invention relate to integrally formed rigid razor blades, razor heads having such blades, and their methods of manufacture.

BACKGROUND OF THE PREFERRED FIRST INVENTION

In particular, the embodiments of the present invention are related to integrally formed rigid razor cutting members.

In the field of mechanical wet shavers, it has long been provided with a shaver which has a head receiving one or more cutting members.

Recently, the trend has been to provide cutting members which have a preferably L-shaped cross-section, with a cutting edge portion and a base portion which is angled with respect thereto in cross-section transverse to the length direction of the cutting members.

An example of a commercially successful such product can be found in WO 2007/147,420. Such cutting members are so-called 'supported blades', in that the so-called 'cutting part', which has the cutting edge, is assembled to a planar portion of a different part, called 'support part' which preferably has the L-shaped cross-section.

WO 2011/008851 also describes such a supported blade.

Yet, the assembly of these two parts raises the following problems: It is logistically difficult to handle these two different parts; it is difficult to technically handle these very tiny parts in a manufacturing apparatus operating at speeds suitable to reach the demand; it is difficult to guarantee precision of this assembly at these operating speeds, and these assemblies may corrode at the location of the attachment, thereby reducing life expectancy of the overall product.

Therefore, efforts have been made to replace these so-called 'supported blades' by integral bent blades. An example of such efforts can be found for example in US 2007/234,577. However, development of such an integral bent blade is very difficult. Indeed, in supported blades, it is possible to tailor the support part to its specific function, i.e. accurately providing the L-shape, and to separately tailor the cutting part to its specific function, i.e. optimized shaving performance. However, for integral bent blades, there is a need to provide a product with both excellent formability and cutting performance, while still considering the manufacturing process and cost issues.

US 2007/234,577 proposed to use a material having a composition comprised of 0.35 to about 0.43 percent carbon, about 0.90 to about 1.35 percent molybdenum, about 0.40 to about 0.90 percent manganese, about 13 to about 14 percent chromium, no more than about 0.030 percent phosphorus, about 0.20 to about 0.55 percent silicon, and no more than 0.025 percent sulfur. However, this only defines at most 18% of the material composition. According to an example, US 2007/234,577 recommends the use of a stainless steel having a carbon content of about 0.4 percent by weight, and other constituents. However, US 2007/234,577 needs to apply a local heat treatment to increase the ductility of the portion of the blade to be bent. However, this additional step is complex to implement on an industrial scale.

Another example of such efforts can be found in US 2007/124,939. However, this document defines a very general class of steels for their razor blades, namely with a very broad range of carbon content, between 0.50%-1.25%. The properties of these materials will extend in a very broad range.

The embodiments of the present invention have objectives to mitigate the drawbacks described above.

SUMMARY OF THE PREFERRED FIRST INVENTION

To this aim, it was surprisingly discovered that a razor blade of martensitic stainless steel with a higher carbon content would provide an optimal response to the competing requirements of formability of the bent portion and strength of the blade edge, while still being manufacturable with all the other listed requirements.

In particular, an integrally formed rigid razor blade having a body with:

- a cutting edge portion extending about a cutting edge portion plane, and having a cutting edge at one end,
- a base portion extending along a base portion plane,
- a bent portion intermediate the cutting edge portion and the base portion,
- and whereift the body is made of martensitic stainless steel comprising mainly iron and between 0.62% and 0.75% of carbon in weight.

In some embodiments, one might also use one or more of the features defined in the dependent claims.

BACKGROUND OF THE PREFERRED—SECOND INVENTION

Other embodiments of the present invention are related to razor heads with movable, integrally formed rigid razor blades.

In the field of mechanical wet shavers, it has long been provided with a shaver which has a head receiving one or more cutting members. The cutting members are mounted to move (mainly translate) inside the head when shaving.

Recently, the trend has been to provide cutting members which have a preferably L-shaped cross-section, with a cutting edge portion and a base portion which is angled with respect thereto in cross-section transverse to the length direction of the cutting members.

An example of a commercially successful such product can be found in WO 2007/147,420. Such blades are so-called 'supported blades', in that the so-called 'cutting part', which preferably has the cutting edge, is assembled to a planar portion of a different part, called 'support part' which has the L-shaped cross-section.

In particular, the base portion is oriented along a base portion axis which defines the direction of movement of the cutting members in the head.

Yet, the assembly of these two parts raises the following problems: It is logistically difficult to handle these two different parts; it is difficult to technically handle these very tiny parts in a manufacturing apparatus operating at speeds suitable to reach the demand; it is difficult to guarantee precision of this assembly at these operating speeds, and these assemblies may corrode at the location of the attachment, thereby reducing life expectancy of the overall product.

Therefore, efforts have been made to replace these so-called 'supported blades' by integral bent blades. Although some patent documents show some drawings of razor heads with integral movable bent blades, it is believed that no commercial product is yet available with such features. It is believed to be due to the difficulty of designing such a product. Indeed, such drawings can for example be found in U.S. Pat. No. 4,621,424, filed as early as 1984.

An issue with a product which would be designed according to the above drawing is that, during shaving, the blade might not remain sufficiently straight, and would be submitted to bending, thus deteriorating shaving performance, and/or would witness the apparition of micro-cracks, thus favoring corrosion. In 1990, U.S. Pat. No. 5,010,646 proposed to solve these problems by providing corrugations on the blade. However, this product was probably difficult to manufacture, and the effect on shaving performance appears doubtful, so that further research on such products have then be abandoned.

The embodiments of the present invention are to provide a head with integral bent blades.

SUMMARY OF THE PREFERRED SECOND INVENTION

To this aim, a razor head is provided comprising:

- a housing having a top face defining a shaving window, and an opposed stopping face, the housing further comprising at least one guide,
- at least one integrally formed rigid razor blade, each freely mounted in the housing, and having:
- a cutting edge portion extending along a cutting edge portion axis, and having a cutting edge accessible through the shaving window,
- a guided portion extending along a guided portion axis, and
- a bent portion intermediate the cutting edge portion and the guided portion,
- wherein the cantilever dimension, measured as the distance between the cutting edge and the guided portion axis, is between 1.1 millimeter and 1.8 millimeter,
- wherein the guided portion cooperates with the guide so that each blade is independently translatable with respect to the housing along a sliding direction parallel to the guided portion axis, under the effect of shaving forces applied to the blade during shaving.

It was discovered that the above-defined parameter was a key factor for the shaving performance of such a razor head. Keeping this parameter in the defined limits enables to optimize shaving performance. Indeed, for razor heads with razor blades having this dimension greater than 1.8, there is a risk to have a bigger head in order to have sufficient rinsability.

Further, blade deflection would be difficult to control.

For blades having this dimension lower than 1.1, handling and assembling becomes strenuous. Further, the probability of damaging the blade cutting edge during manufacturing increased dramatically. Also, controlling the spring force applied by lateral spring arms in heads with movable blades proved more difficult.

In some embodiments, one might also use one or more of the features defined in the dependent claims.

BACKGROUND OF THE PREFERRED THIRD INVENTION

Other embodiments of the present invention are related to integrally formed rigid razor blades.

In the field of mechanical wet shavers, it has long been provided with a shaver which has a head receiving one or more cutting members.

Recently, the trend has been to provide cutting members which have a preferably L-shaped cross-section, with a cutting edge portion and a base portion which is angled with respect thereto in cross-section transverse to the length direction of the cutting member.

An example of a commercially successful such product can be found in WO 2007/147,420. Such cutting members are so-called 'supported blades', in that the so-called 'cutting part', which has the cutting edge, is assembled to a planar portion of a different part, called 'support part' which preferably has the L-shaped cross-section.

Yet, the assembly of these two parts raises the following problems: It is logistically difficult to handle these two different parts; it is difficult to technically handle these very tiny parts in a manufacturing apparatus operating at speeds suitable to reach the demand; it is difficult to guarantee precision of this assembly at these operating speeds, and these assemblies may corrode at the location of the attachment, thereby reducing life expectancy of the overall product.

Therefore, efforts have been made to replace these so-called 'supported blades' by integral bent blades. An example of such efforts can be found for example in US 2007/234,577. However, development of such an integral bent blade is very difficult. Indeed, in supported blades, it is possible to tailor the support part to its specific function, i.e. accurately providing the L-shape, and to separately tailor the cutting part to its specific function, i.e. cutting hair. However, for integral bent blades, there is a need to provide a product both with excellent formability and cutting performance, while still considering the manufacturing process and cost issues.

US 2007/234,577 proposed a very short bent portion. In particular, the radius of curvature R of the inner face of the bent portion is to be set to 0.45 millimeter or lower.

As recognized later in WO 2011/06760 by the same applicant, the stringent material requirements for the blade edges limit the amount blades can be bent consistently and accurately. WO 2011/06760 teaches to reduce the bending angle with, as visible on the drawings, a radius of curvature close to 0.

However, it is rather believed that reducing the radius of curvature would favor unwanted apparition of cracks during manufacture. These cracks ought to be avoided, because they may cause permanent deformation to occur when shaving, thereby reducing shaving performance, or corrosion to start.

The embodiments of the present invention are to mitigate the drawbacks described above.

SUMMARY OF THE PREFERRED THIRD INVENTION

To this aim, it is provided an integrally formed rigid razor blade made of martensitic stainless steel and having in cross-section :

a cutting edge portion extending along a cutting edge portion axis, and having a cutting edge at one end, a base portion extending along a base portion axis, a bent portion intermediate the cutting edge portion and the base portion, the blade having a concave face and an opposed convex face, and wherein the average radius of curvature of the bent portion at its concave face is between 0.5 and 1 millimeter.

By increasing the radius of curvature of the inner face of the bent portion, the product can be manufactured by a rather mild manufacturing process, which would respect the constitutive material, and occurrence of cracks during this manufacture would be reduced. In some embodiments, one might also use one or more of the features defined in the dependent claims.

BACKGROUND OF THE PREFERRED FOURTH INVENTION

In particular, other embodiments of the present invention are related to methods of manufacture of integrally formed rigid razor blades.

In the field of mechanical wet shavers, it has long been provided with a shaver which has a head receiving one or more cutting members.

Recently, the trend has been to provide cutting members which have a preferably L-shaped cross-section, with a cutting edge portion and a base portion which is angled with respect thereto in cross-section transverse to the length direction of the blade.

An example of a commercially successful such product can be found in WO 2007/147,420. Such cutting members are so-called 'supported blades', in that the so-called 'cutting part', which preferably has the cutting edge, is assembled to a planar portion of a different part, called 'support part' which preferably has the L-shaped cross-section.

Yet, the assembly of these two parts raises the following problems: It is logistically difficult to handle these two different parts; it is difficult to technically handle these very tiny parts in a manufacturing apparatus operating at speeds suitable to reach the demand; it is difficult to guarantee precision of this assembly at these operating speeds, and these assemblies may corrode at the location of the attachment, thereby reducing life expectancy of the overall product.

Therefore, efforts have been made to replace these so-called 'supported blades' by integral bent blades. An example of such efforts can be found for example in US 2007/234,577. However, development of such an integral bent blade is very difficult. Indeed, in supported blades, it is possible to tailor the support part to its specific function, i.e. accurately providing the L-shape, and to separately tailor the cutting part to its specific function, i.e. optimized shaving performance. However, for integral bent blades, there is a need to provide a product both with excellent formability and cutting performance, while still considering the manufacturing process and cost issues.

In particular, it is necessary to limit as much as possible the degree of deformations applied to the blades during their manufacture, so as to not introduce permanent deformations which would affect shaving performance.

US 2007/234,577 proposed slots between to-be adjacent cutting members. However, it is still difficult to handle such tiny strips, or parts separated therefrom, at high speed.

The embodiments of the present invention has an objective to improve the efficiency of the manufacturing process, while not adversely affecting the characteristics of the final product.

SUMMARY OF THE PREFERRED FOURTH INVENTION

To this aim, a method of manufacturing an integrally formed razor blade is provided comprising:

providing a strip having, in cross-section transverse to a long axis, a blade portion and a removable portion, wherein weakening holes are provided along the long axis between the blade portion and the removable portion, separating the blade portion from the removable portion by breaking the strip at the weakening holes, providing the razor blade with a profile having:

a cutting edge portion extending along a cutting edge portion axis, and having a cutting edge at one end, a base portion extending along a base portion axis, and having an abutment edge at one end, a bent portion intermediate the cutting edge portion and the guided portion, wherein the abutment edge is corrugated along the long axis, with corrugations with a height of at most 0.3 millimeters.

Thereby, the handled strip can be made longer, and easier to handle. Further, by using a pre-perforated strip, separation of the blade from the strip is performed by imparting minimal deformation to the strip, thereby improving the overall consistency of the manufactured product.

BACKGROUND OF THE PREFERRED FIFTH INVENTION

In particular, a fifth invention is related to methods of manufacturing integrally formed rigid razor blades.

In the field of mechanical wet shavers, it has long been provided with a shaver which has a head receiving one or more cutting members.

Recently, the trend has been to provide cutting members which have a preferably L-shaped cross-section, with a cutting edge portion and a base portion which is angled with respect thereto in cross-section transverse to the length direction of the cutting members.

An example of a commercially successful such product can be found in WO 2007/147,420. Such cutting members are so-called 'supported blades', in that the so-called 'cutting part', which preferably has the cutting edge, is assembled to a planar portion of a different part, called 'support part' which preferably has the L-shaped cross-section.

Yet, the assembly of these two parts raises the following problems: It is logistically difficult to handle these two different parts; it is difficult to technically handle these very tiny parts in a manufacturing apparatus operating at speeds suitable to reach the demand; it is difficult to guarantee precision of this assembly at these operating speeds, and these assemblies may corrode at the location of the attachment, thereby reducing life expectancy of the overall product.

Therefore, efforts have been made to replace these so-called 'supported blades' by integral bent blades. An example of such efforts can be found for example in US 2007/234,577. However, development of such an integral bent blade is very difficult. Indeed, in supported blades, it is possible to tailor the support part to its specific function, i.e.

accurately providing the L-shape, and to separately tailor the cutting part to its specific function, i.e. cutting hair. However, for integral bent blades, there is a need to provide a product both with excellent formability and cutting performance, while still considering the manufacturing process and cost issues.

One attempt at manufacturing bent blades can be found in US 2007/234,577. In this document, the blades are shaped by coining. However, it is believed that this process still provides a wide dispersion of resulting geometries.

The embodiments of the invention has an objective to improve the consistency of the products existing from manufacturing process, i.e. to reduce the dispersion in geometry of the manufactured products.

SUMMARY OF THE PREFERRED FIFTH INVENTION

A method of manufacture of an integral bent blade for a mechanical shaver, comprises:

- providing a flat strip of metal extending from a first edge to an opposite edge,
- bending the flat strip along a bending axis parallel to the first edge to result in an integrally bent product having opposed inner and outer faces, and comprising:
- a cutting edge portion extending along a cutting edge portion axis, and having the first edge at one end,
- a base portion extending along a base portion axis, and having the opposite edge at one end,
- a bent portion intermediate the cutting edge portion and the base portion, and after bending, applying a mechanical stress on the inner face of the bent portion.

It has been discovered that application of this mechanical stress after bending straightens the bent blade, and thus reduces the amount of products which did not meet the requested geometrical specifications.

BRIEF DESCRIPTION OF THE DRAWINGS

Other characteristics and advantages of the embodiments of the present invention will readily appear from the following description of some of its embodiments, provided as a non-limitative examples, and of the accompanying drawings.

On the drawings.

On the different Figures, the same reference signs designate like or similar elements.

DETAILED DESCRIPTION

Figure 1:
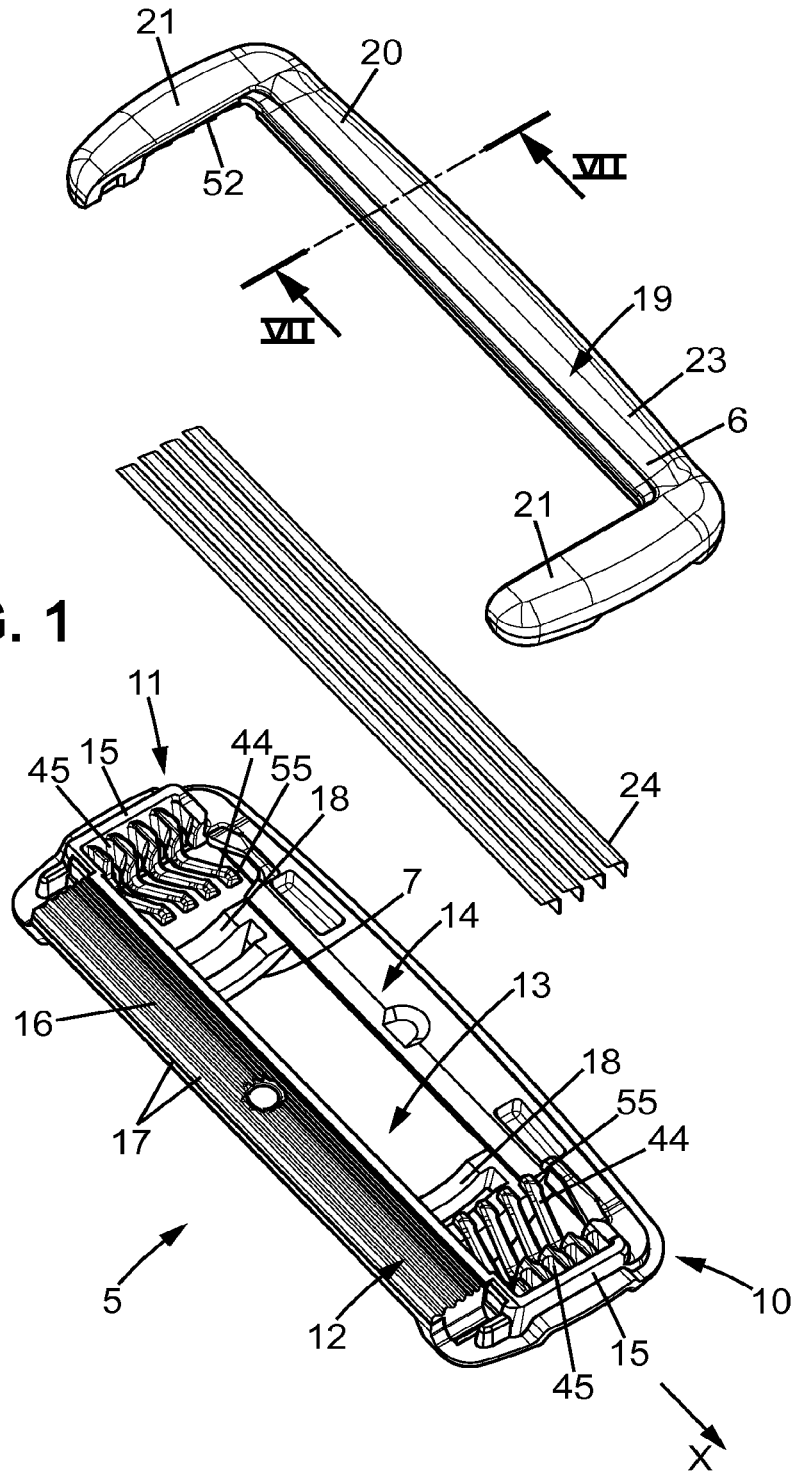
FIG. 1 is an exploded perspective view of a razor head according to an embodiment.

FIG. 1 shows a head 5 of a safety razor (also called wet shaver), the blades of which are not driven by a motor relative to the blade unit.

The shaving head 5 is to be borne by a handle extending in a longitudinal direction between a proximal portion and a distal portion bearing the blade unit 5 or shaving head. The longitudinal direction may be curved or include one or several straight portions.

The blade unit 5 includes an upper face 6 defining a shaving window, and equipped with one or several cutting members and a lower face 7 which is to be connected to the distal portion of the handle by a connection mechanism. The connection mechanism may for instance enable the blade unit 5 to pivot relative to a pivot axis X which is preferably substantially perpendicular to the longitudinal direction. The connection mechanism may further enable selectively releasing the blade unit for the purpose of exchanging blade units. One particular example of a connection mechanism usable in the present invention is described in document WO-A-2006/027018, which is hereby incorporated by reference in its entirety for all purposes.

The blade unit 5 includes a frame 10 which is made solely of synthetic materials, i.e. thermoplastic materials (polystyrene or ABS, for example) and elastomeric materials.

More precisely, the frame 10 includes a plastic platform member 11 connected to the handle by the connection mechanism and having:

- a guard bar 12 extending parallel to the pivot axis X,
- a blade receiving section 13 situated rearward of the guard 12 in the direction of shaving,
- a rear portion 14 extending parallel to the pivot axis X and situated rearward of the blade receiving section 13 in the direction of shaving,
- and two side portions 15 joining the longitudinal ends of the guard bar 12 and of the rear portion 14 together.

In the example shown in the figures, the guard bar 12 is covered by an elastomeric layer 16 forming a plurality of fins 17 extending parallel to the pivot axis X.

Further, in this particular example, the underside of the platform member 11 includes two shell bearings 18 which belong to the connection mechanism 8 and which may be for example as described in the above-mentioned document WO-A-2006/027018.

The frame 10 further includes a plastic cover 19 having a top face and an opposite bottom face, which faces the top face of the components of the platform 11. The cover 19 exhibits a general U shape, with a cap portion 20 partially covering the rear portion 14 of the platform and two side members 21 covering the two side members 15 of the platform. In this embodiment, the cover 19 does not cover the guard bar 12 of the platform.

The cap portion 20 of the cover 19 may include a lubricating strip 23 which is oriented upward and comes into contact with the skin of the user during shaving. This lubricating strip may be formed for instance by co-injection with the rest of the cover. The cover 19 is assembled to the platform 11 by any suitable means, such as, for example, by ultra-sonic welding, as explained in WO 2010/06,654, hereby incorporated here in its entirety for all purposes.

The present description of a housing is exemplary only.

At least one cutting member 24 is movably mounted in the blade receiving section 13 of the platform. The blade receiving section 13 may include several cutting members 24, for instance four cutting members as in the example shown in the drawings.

Each cutting member 24 is made of a blade which is integrally formed from a flat steel strip.

In particular, one may use a martensitic stainless steel with the following composition (in weight):

Carbon: between 0.62% and 0.75%,
Chromium: between 12.7% and 13.7%,
Manganese: between 0.45% and 0.75%,
Silicon: between 0.20% and 0.50%,
Iron: Balance Such an alloy has no more than traces of other components, and notably no more than traces of Molybdenum.

The razor blade has a cutting edge 26 oriented forward in the direction of shaving and an opposed rear edge 54. The cutting edge 26 is accessible through the shaving window of the blade-receiving section 13, to cut hair. Each blade 25 preferably has an outer face 27 oriented towards the skin to be shaved and an opposed inner face 28. The outer and inner faces 27, 28 of the blade include respectively two parallel main surfaces 29, 30 and two tapered facets 31, 32 which taper towards the cutting edge 26.

Each blade 25 extends longitudinally, parallel to the pivot axis X, between two lateral sides 33, 33'. For example, the lateral sides are straight.

Each blade 25 preferably has a bent profile including:

- a substantially flat base portion 35 (for example substantially perpendicular to the shaving plane) having a periodically serrated edge 54,
- a substantially flat cutting edge portion 39 comprising the cutting edge 26,
- a bent portion 53 extending between the base portion and the cutting edge portion. The bent portion preferably has a concave face 28 and an opposed convex face 27. The face of the blade having the concave face is called inner face, and the other one the outer face.

When the blade is mounted to slide in the head, the base portion is also sometimes called "guided portion".

As shown in FIG. 1, each cutting member 24 is borne by two elastic fingers 44 which are molded as a single piece with the platform 11 and which extend towards each other and upwardly from both side members 15 of the platform. For example, all the fingers 44 extending from a given side member are identical.

Figure 2A:
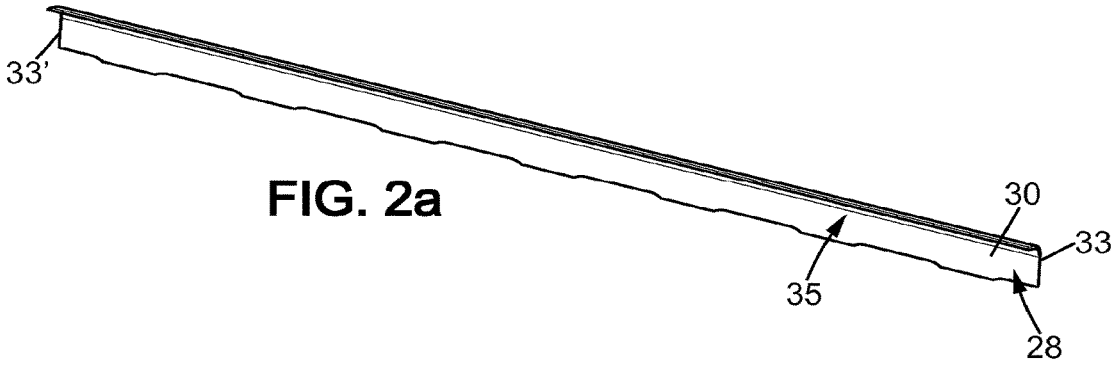
FIGS. 2*a* and 2*b* are two opposed perspective views of an embodiment of an integral bent blade.
Figure 2B:
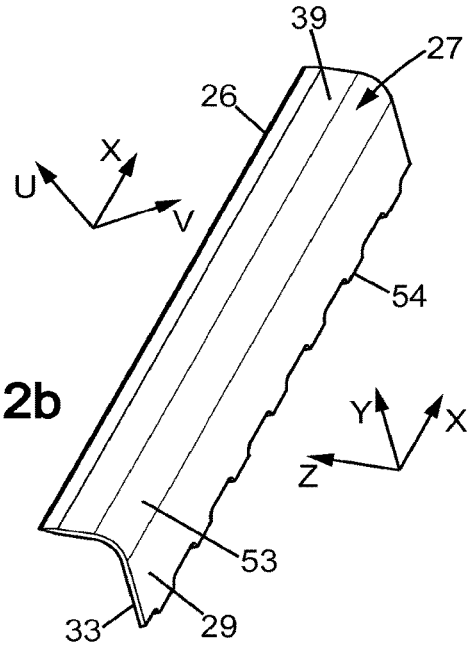

Besides, as shown in FIG. 2, the base portions 35 of the blades are slidingly guided in slots 45 provided in the inner face of each side member 15 of the platform. The slots are, for example, substantially perpendicular to the shaving plane.

The blades 24 are elastically biased by the elastic arms 44 toward a nominal position. In this nominal position, the outer faces 27 of the blades, at each lateral end of the blades, bear against corresponding upper stop portions 52 which are provided on the bottom stopping face of each side member 21 of the cover, the side member 21 covering the slots 45.

Therefore, the nominal position of the blades 24 is well defined, therefore enabling a high shaving precision.

In this nominal position, the inner faces 28 of the blades, at each lateral end of the blades, are borne by corresponding top portions 55 of the elastic arms. The distance between the two top portions is for example of 22 to 30 mm, preferably between 25 and 27 mm.

The guiding slots 45 define a direction Y for the razor head. The direction Z is the normal to the X-Y plane. The base portion 35 extends in a base portion plane. The base portion axis is the main axis of the base portion other than its profile axis, i.e. other than the X axis. In the present embodiment, it is the Y axis. In other words, the main axis along which the base portion extends is the same as the axis defined by the slots 45 in the razor head.

The cutting edge portion 39 extends in a cutting edge portion plane. The cutting edge portion axis is the main axis of the cutting edge portion other than its profile axis, i.e. other than the X axis. In the present embodiment, it is a U axis. In other words, the cutting edge portion axis extends in an X-U plane. A V axis is defined normal to the X-U plane.

Figure 3A:
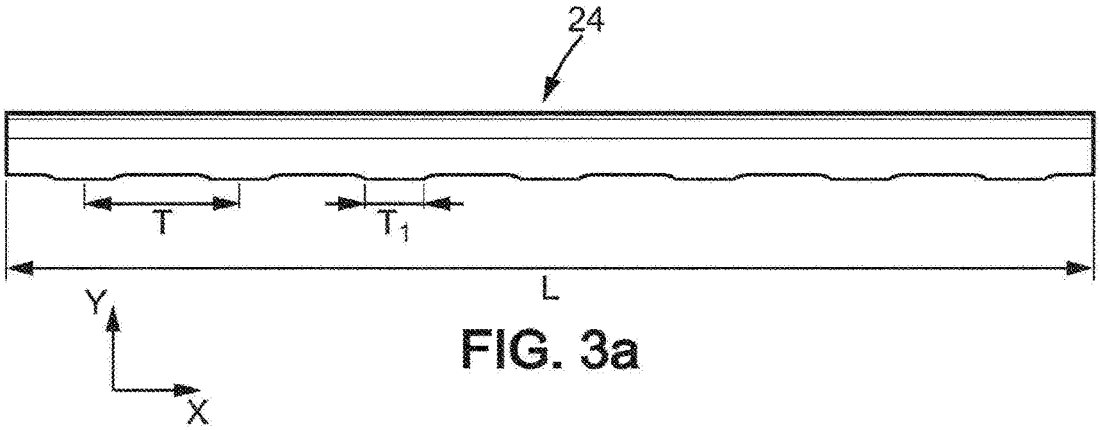
FIG. 3*a* is a rear view of the blade of FIGS. 2*a* and 2*b*.
Figure 3B:
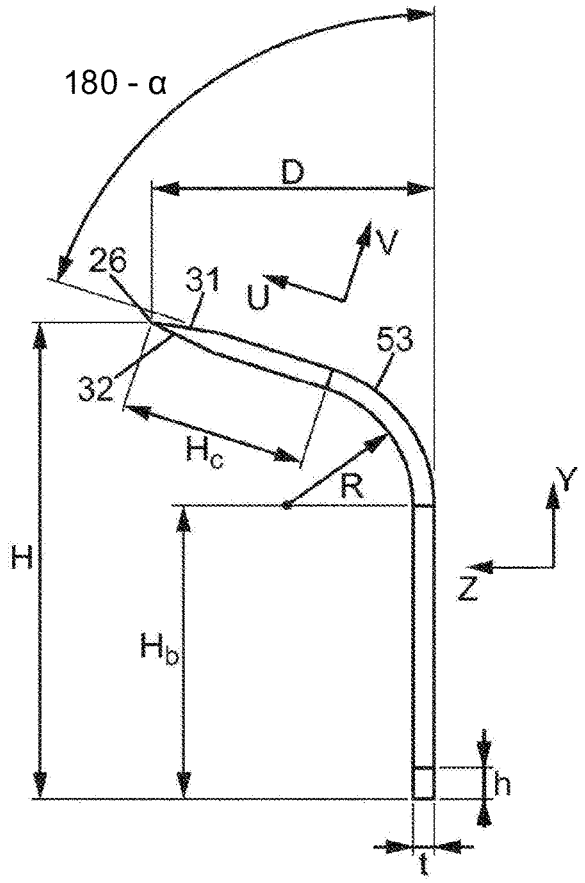
FIG. 3*b* is a lateral view of the blade of FIG. 3*a*, FIGS. 4*a* and 4*b* are views corresponding respectively to FIGS. 3*a* and 3*b* for a second embodiment of a bent blade.

A first embodiment of a bent blade is shown on FIGS. 3*a* and 3*b*. Below, some geometrical characteristics of the blade are given. The geometrical characteristics of the blade are here nominal characteristics, which do not take into account the actual geometry of the blade due to the manufacturing process or dispersion. In particular, due to the manufacturing process, thickness variations and/or bow, sweep, camber of some blade portions are possible, and are even intrinsic to the product.

Following parameters are defined:

- t: thickness of the blade;
- L: length of the blade from one lateral side 33 to another 33';
- H: height of the blade, measured along direction Y, from the rear edge 54 to the cutting edge 26;
- D: cantilever dimension, measured along direction Z, from the cutting edge 26 to the plane of the base portion (X-Y);
- a: included angle, measured between the base portion plane and the cutting edge portion plane;
- Hb: height of the blade base portion, measured along direction Y, from the rear edge 54 to the bent portion 53;
- R: radius of curvature of the inner face of the bent portion;
- Hc: Extent of the cutting edge portion, measured along direction U, from the cutting edge 26 to the bent portion 53;
- T: period of the serrated edge;
- Ti: extent of the protrusion of the serration;
- h: height of the serrated end.

According to the first embodiment, a suitable razor blade shows the following geometric properties:

| Parameter | Nominal value | Dispersion |
|---|---|---|
| T | 0.1 mm | |
| L | 37.1 mm | |
| H | 2.33 mm | |
| D | 1.35 mm | +/−0.05 mm |
| A | 108° | +/−2° |
| Hb | 1.43 mm | |
| R | 0.6 mm | |
| Hc | 0.28-1.14 mm | |
| T | 5.3 mm | ±0.003 mm |
| h | 0.13-0.32 mm | |
| Ti | 2 mm | |

This value indicated for Hc is in fact an average between the value measured for Hc on both lateral sides of the blade. Due to the deformation of the blade, these two values were different, amounting in average to 0.81 mm and 0.85 mm, respectively. Hc might extend between 0.28 and 1.14 mm, preferably between 0.4 and 1 mm.

Figure 4A:
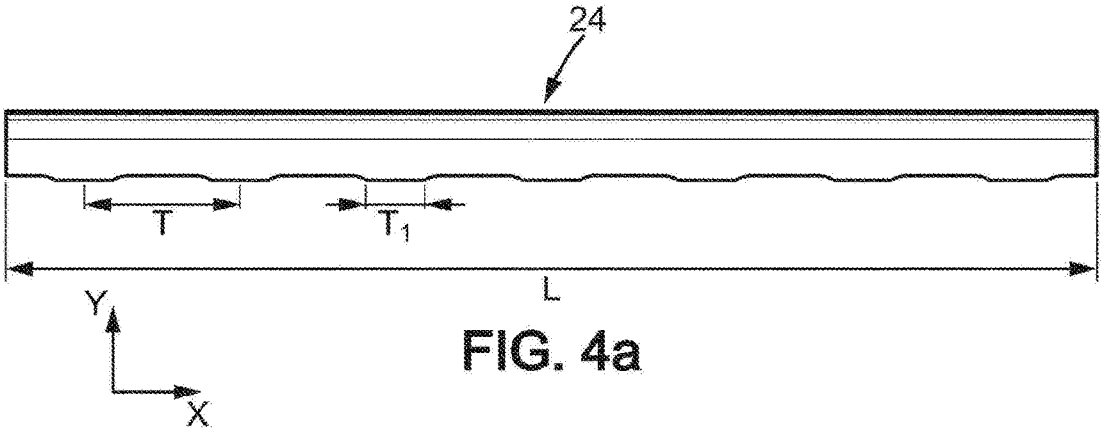
Figure 4B:
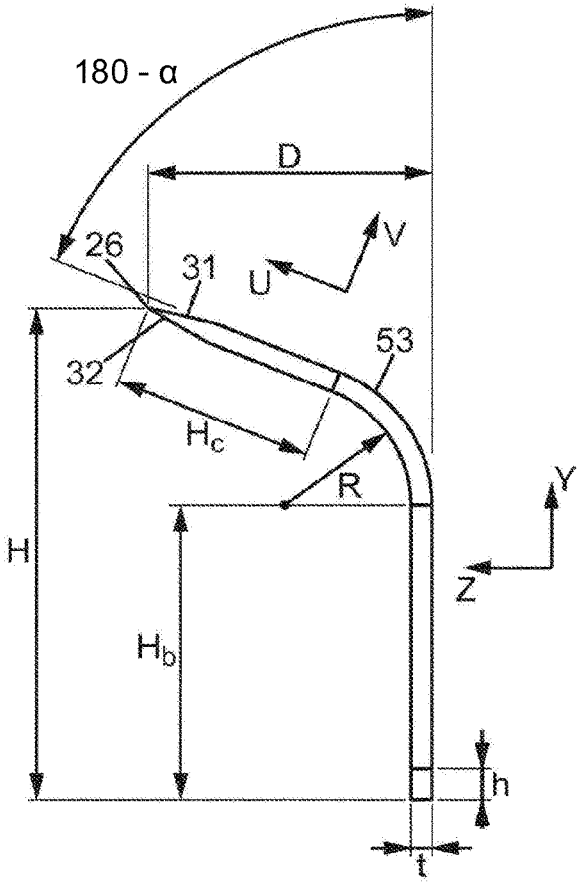

Other embodiments were successfully manufactured, which showed satisfactory. According to a second embodiment, shown on FIGS. 4*a* and 4*b*, the other parameters are alike, apart from a=112°, H=2.4 mm, Hc=0.96 mm.

Figure 5:
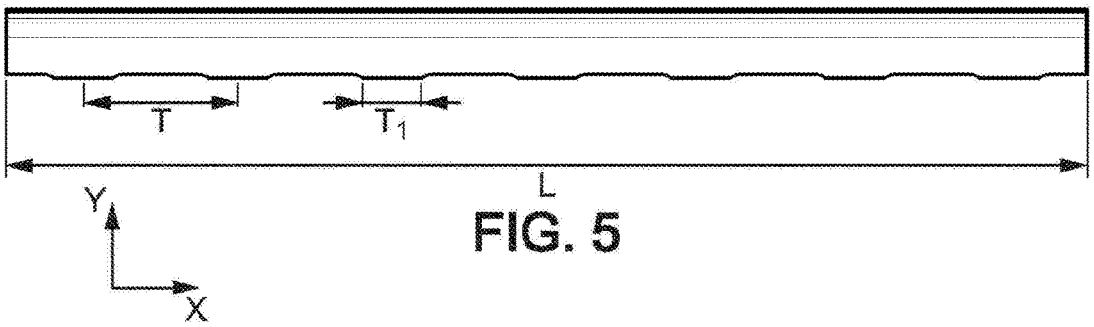
FIG. 5 is a view corresponding to FIG. 3*a* for a third embodiment of a bent blade.

Yet another embodiment is shown on FIG. 5. This embodiment differs from the second embodiment mainly by different values for T and Ti.

Figure 6A:
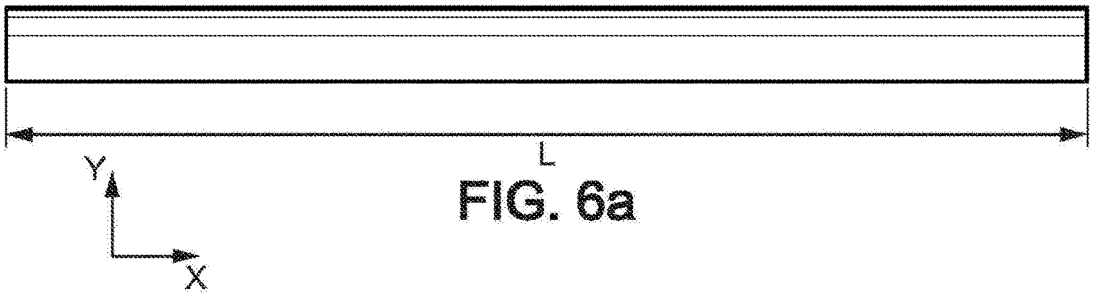
FIGS. 6*a* and 6*b* are views corresponding respectively to FIGS. 3*a* and 3*b* for a fourth embodiment of a bent blade.
Figure 6B:
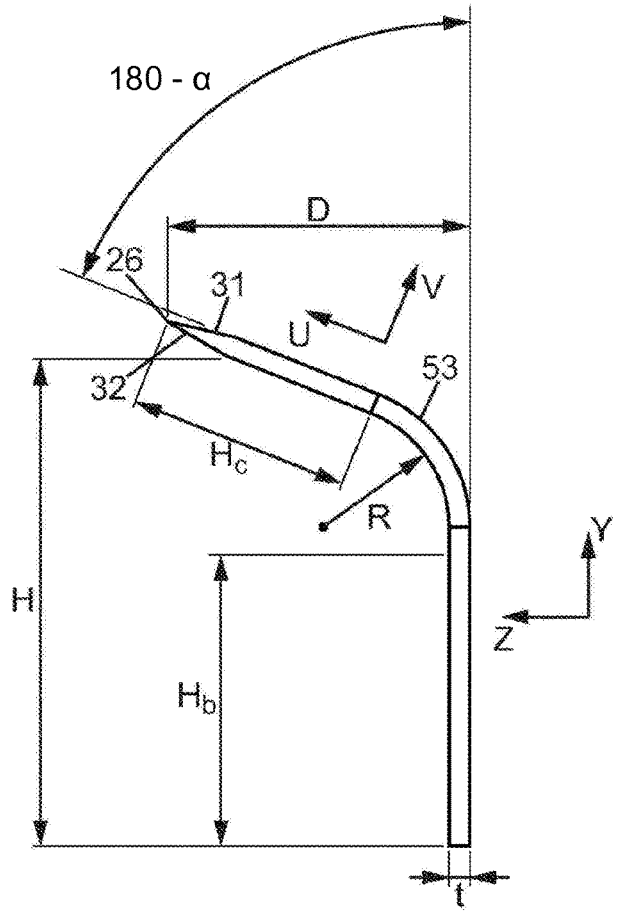

According to yet another embodiment, as shown on FIGS. 6*a* and 6*b*, the rear edge is not serrated. The geometric datas for this embodiment are:

| Parameter | Nominal value |
|---|---|
| t | 0.1 mm |
| L | 37.1 mm |
| H | 2.58 mm |
| D | 1.45 mm |
| Hb | 1.57 mm |
| R | 0.6 |
| Hc | 1.07 |
| a | 112° |

Figure 7:
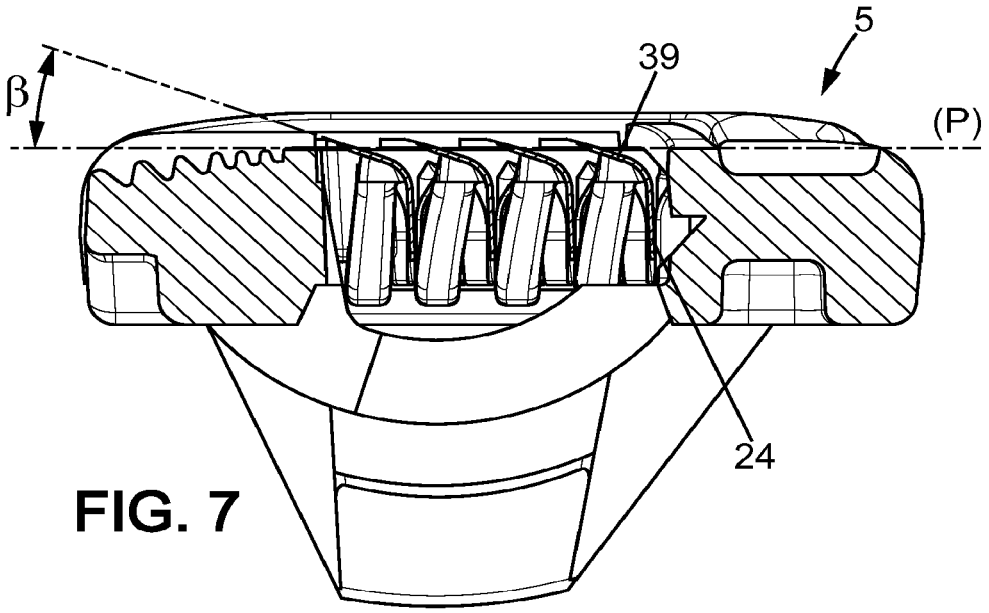
FIG. 7 is a schematic sectional view along line VII-VII on FIG. 1, FIGS. 8*a* and 8*b* are schematic views of intermediate products of the manufacture of a razor blade.

As shown on FIG. 7 below, a cutting plane (P) is defined for the head from the tangents to guard bar before the window receiving the blades and the cap behind it. Hence, upon shaving, a force will be applied to the blade by the user, along a direction F which is preferably normal to the plane (P). The blades 24 are oriented in the head 5 such that the cutting edge portion forms an angle with the cutting plane (P). In other words, the force F is applied preferably in the Y direction at approximately ±5°.

According to the first embodiment of the present invention, tests have shown that, surprisingly, the above material provided a bent blade providing the best compromise between formability and cutting edge performance. In particular, the above material can be formed as a successful cutting edge of a razor blade, provided with current cutting edge processing including grinding, coating with a strengthening material and coating with a telomere layer. In addition, the above material can be formed as a successful bent region with enhanced consistency, high reproducibility, and without producing too much corrosion prone macro-cracks during manufacturing.

These tests were performed both for a head with a blade according to the first embodiment above, and for another blade with an angle a of 112°. It is expected that this material would provide improved behavior even when modifying other parameters of the blade. In particular, it is believed to be verified for a taken between 95° and 140°; preferably between 108° and 112°, R over 0.4 mm, preferably between 0.5 mm and 1 mm, t between 0.07 mm and 0.12 mm, preferably between 0.095 mm and 0.105 mm, He between 0.28 mm and 1.14 mm, preferably between 0.4 mm and 1.0 mm. The thus obtained blade may also be used fixed in a razor head, if necessary.

According to the second invention, with the blade edge portion 39 being supported only by the two springs 44, the shaving force being applied along direction F therebetween, and the base portion constrained to move parallel to the X-Y plane, the dimension D has proven to be a critical dimension of the blade.

Tests have shown that an optimum can be reached when the D dimension is selected between 1.1 mm and 1.8 mm. If D exceeded 1.8 mm, the blade would be submitted to large deflection during shaving, thereby reducing shaving performance. Head rinsability would also be reduced. Further, there would be a risk of appearance of macro-cracks in the blade, notably in the inner face of the bent region, and/or permanent deformation of the blade. Macro-cracks ought to be avoided, because they are a preferred site for the corrosion of the blade. Permanent deformation ought to be avoided, because it would negatively affect shaving performance. When D becomes lower than 1.1 mm handling and manufacturability are dramatically impaired. There is a risk of damaging the cutting edge during handling and head manufacture. Further, applying a suitable spring force on the blade becomes difficult.

These tests were performed for a head with a blade according to the first embodiment above, but it is expected that heads provided with movable blades guided along their base portion axis, and with the selected D dimension would provide improved performance, even when modifying other parameters of the blade, such as its material, or other geometrical parameters. In particular, it is believed to be verified when the distance between the two contact points of the blade to the springs is between 22 and 30 mm, preferably between 25 and 27 mm, when a is taken between 95° and 140°, preferably between 108° and 112°, R over 0.4 mm, preferably between 0.5 mm and 1 mm, t between 0.07 mm and 0.12 mm, preferably between 0.095 and 0.105 mm, He between 0.4 mm and 1.0 mm, preferably between 0.81 mm and 0.85 mm. Such a preferential behaviour is also expected to be met for bent blades with lower carbon range, for example from 0.5% carbon in weight.

According to the third invention, tests have shown that an optimum can be reached when the R dimension is selected over 0.5 mm, preferably over 0.55 mm. The R dimension is preferably lower than 1 mm. In other words, the radius of curvature of the outer face at the bent portion is at least 0.57 mm. The median radius of curvature at the bent portion is at least 0.535 mm. Indeed, when the radius of curvature is lower than that, it is difficult to manufacture the blade without generating high stresses which would cause the appearance of macro-cracks in the bent region.

These tests were performed for a blade according to the first embodiment above, but it is expected that the above would remain true even when modifying other parameters of the blade. In particular, it is believed to be verified for a taken between 95° and 140°, preferably between 108° and 112°, t between 0.07 mm and 0.12 mm, preferably between 0.095 and 0.105 mm. The thus obtained blade may also be used fixed in a razor head, if necessary.

Figure 10:
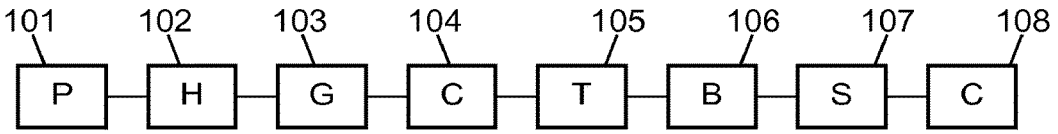
FIG. 10 is a chart of a manufacturing process for a bent blade.

FIG. 10 now schematically shows an example of a process for the manufacture of the above bent blades.

Figure 8A:
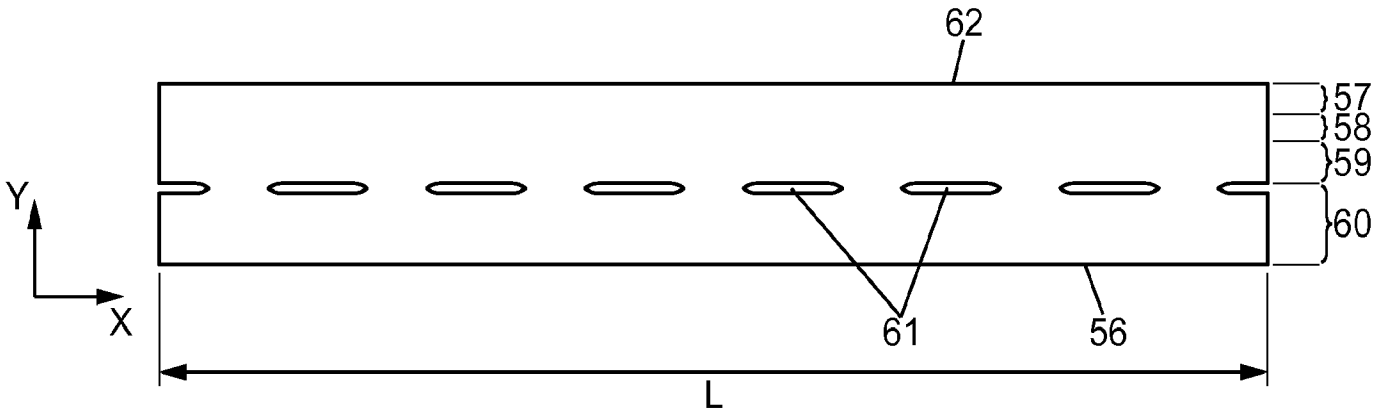

At step 101, one provides a strip of suitable material. The material is for example stainless steel in terrific form with secondary carbides, and having the above composition. A strip is any kind of product suitable to be manufactured into a bent blade as above. For example, the strip 56 is shown on FIG. 8*a*. It is substantially straight. It has the thickness of the future razor blade. It has the length L of the future razor blade. Along the transverse height direction, it comprises, from top to bottom on FIG. 8*a*, a cutting edge portion 57, a to-be-bent portion 58, a base portion 59, and a removable portion 60. The cutting edge portion 57, the to-be-bent portion 58 and base portion 59 together define a blade portion of the strip. Notches 61 are provided, which extend oblongly along the long direction, between the base portion 59 and the removable portion 60.

In particular, the notches 61 are shaped to receive transport fingers of the manufacture apparatus, in order to transport the strip from one station to another, along the manufacturing line, and to hold the strip in respective stations, as will be explained below in relation to FIG. 11.

At step 102, a metallurgical hardening process 102 is performed on the strip. This process initiates martensitic transformation of the steel.

At step 103, the top edge of the strip, which is to become the cutting edge, i.e. the edge of the strip which belongs to the cutting edge portion 57, is shaped as the cutting edge of a razor blade. This shaping is a sharpening process performed by grinding the edge to the acute required geometry. The cutting edge is defined by convergent faces which taper toward a tip having an angle of about 10°-30°.

At step 104, a strengthening coating is applied on the ground cutting edge. For example, the ground blades are stacked in a stack, with their cutting edges all oriented in the same direction, and a strengthening coating is applied thereto. The strengthening coating will comprise one or more layers with different characteristics. The layers may comprise one or more of metal(s) (notably chromium or platinum) and carbon (possibly in DLC form). This coating is for example deposited by sputtering. Sputtering may also be used to precisely shape the geometry of the cutting edge before or after coating. The global geometry of the cutting edge is maintained at this step.

At step 105, a telomere coating is applied on the blade edge. A suitable telomere is for example a PTFE. A suitable deposition method is spraying.

What is referred to as being the blade body is the part of the blade which is made of steel, exclusive the coatings.

Figure 8B:
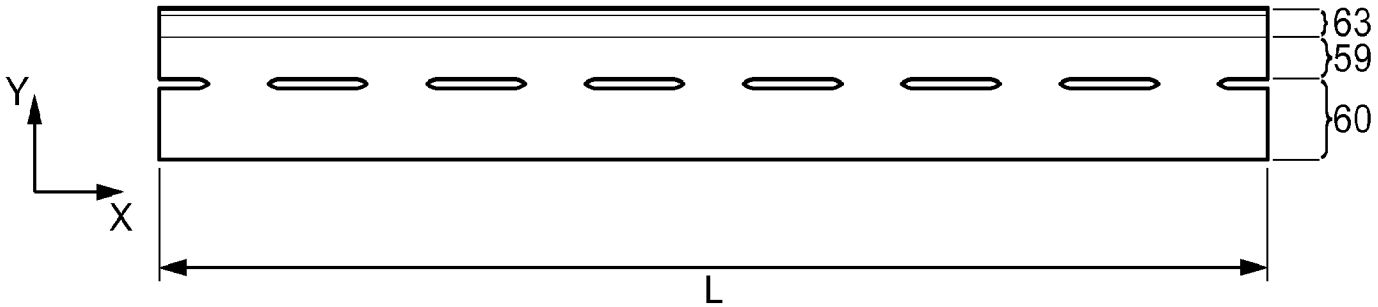

At step 106, a bending step is applied on the up-to-now straight strip. At the bending step 106, one part of the strip is held, and a force is applied on the other part, so as to provide the strip with a bent portion 63, as shown on FIG. 8*b*. After this step, the cutting edge portion 57 is angled with respect to the base portion by preferably the above angle a. Permanent deformation is imparted on the bent portion. Bending could for example be performed by stamping. Alternately, bending could be done by a number of other suitable methods. A method which reduces the generation of macro-cracks in the strip, notably to its bent portion, is preferred.

Due to the natural characteristics of the material, the bent strip exiting from this step will not have the nominal geometry described above. In particular, it will exhibit some degree of camber, bow or sweep. Further, due to the material's mechanical properties, the dispersion of the geometry of the products can be large. This is particularly the case when the process used for applying the bending is only mildly severe to the strip (in order to avoid appearance of cracks). In such case, the amount of spring-back of the material after deformation is high and hardly predictable.

According to the fifth invention, at step 107, a straightening step is performed. At this step, a forming process is used in order to reduce the dispersion in the geometry of products. In particular, permanent deformation is applied on the inner face of the bent portion of the strip. This permanent deformation straightens the overall blade, and reduces the dispersion in blade geometry among the products.

Figure 9:
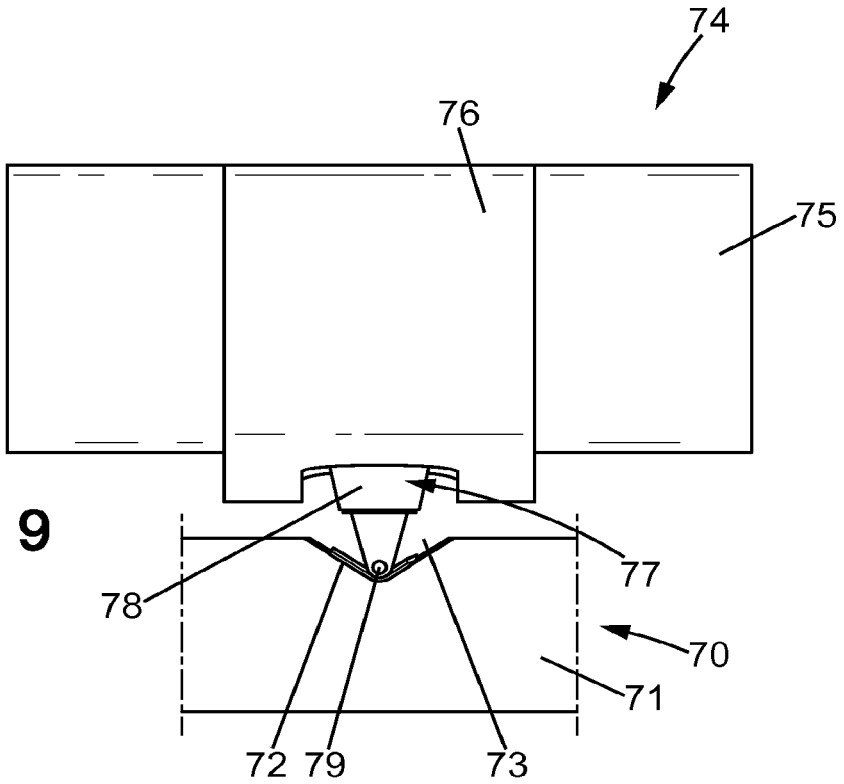
FIG. 9 is a lateral view of an embodiment of a forming tool used for the manufacture of a bent blade.

As an example, as shown on FIG. 9, a straightening station 70 comprises a support 71 to receive the bent strip 72. For example, the support 71 preferably has a V-shaped groove 73 having an included angle corresponding to the nominal angle for the bent blade. The bent strip is placed in the groove 73 with its outer surface resting on the arms of the V-shaped groove. It may be maintained there by any suitable means, such as by vacuum suction or the like. A deformation tool 74 is placed above the groove 73. The deformation tool 74 preferably has a base 75 receiving a carriage 76 movably mounted with respect to the base 75 along the length direction of the strip (transverse to the plane of FIG. 9). The carriage 76 bears a pressure-application tip 77. The position of the pressure-application tip 77 with respect to the carriage 76 is settable, so as to bring the pressure-application tip at controlled distance to the base 71. The distance between the edge of the tip 77 and the groove 73 will determine the level of pressure applied by the tip to the strip.

The pressure-application tip may comprise a support 78 receiving a spring-loaded ball 79 at its edge. The ball has dimensions of the order of the bent portion of the strip. The support 78 allows rotation of the ball 79 therein.

Upon use, the tip 77 is held in an upper position until a strip is placed in the groove 73. The tip 77 is moved down until the ball 79 contacts the bent portion of the strip with suitable pressure. The ball 79 does not contact the straight portions of the strip. The contact is made at one lateral side of the strip. Then, the carriage 76 is moved with respect to the base 75 along the length of the strip until the other lateral side, to form the bent portion of the strip. The ball rolls during this movement. Possibly, this movement is performed back-and-forth. The tip 77 is then moved again to its up position, to remove the straightened strip from the straightening station 70. [00132] The formed strip is controlled. For example, its geometry is measured with a suitable measurement apparatus. These measurements enable to set the level of pressure applied by the tip for straightening steps on future products.

Back to FIG. 10, a cutting step 108 is performed. At this step, the removable portion 60 is removed, to result in the final bent blade. According to a fourth invention, it is made use of the notches 61 which are provided between the base portion and the removable portion of the blade, to remove the removable portion. It enables to remove the removable portion by imparting minimal stress on the bent blade, thus minimizing the level of permanent deformation applied to the bent blade, and potentially affecting its geometry. Further, as the cut part surface is minimized, initiation of corrosion is also reduced to the small cut area.

Figure 11:
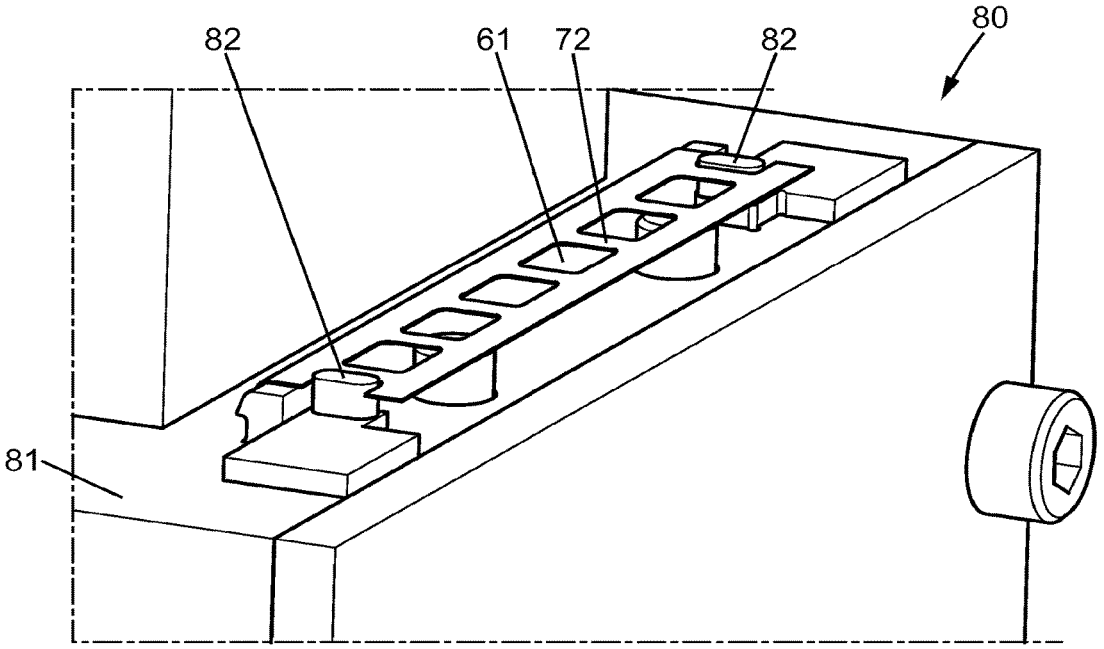
FIG. 11 is a perspective schematic view of a holding tool for a bent blade.

Cutting can be performed in a cutting station 80 partially shown on FIG. 11. The station 80 preferably has a base 81 from which two lateral pins 82 extend. The pins 82 are shaped to enter in corresponding notches 61 of the strip, and together precisely locate the strip in the station. Vacuum may additionally be used to retain the strip in the station by suction. The strip, at various stages of its manufacture, can be held in manufacturing stations, and/or moved from one station to the next, using similar principles.

In various embodiments, the order in which some of the above steps are implemented may be changed.

The invention claimed is:

1. An integrally formed rigid razor blade made of martensitic stainless steel comprising:

a cutting edge portion extending along a cutting edge portion axis, and having a cutting edge at one end, a base portion extending along a base portion axis, a bent portion intermediate the cutting edge portion and the base portion, the bent portion having a concave face and an opposed convex face, wherein an average radius of curvature of the concave face of the bent portion is between 0.5 millimeters and 1 millimeters, the martensitic stainless steel consisting essentially of the following components, in weight:

between 0.50% and 0.75% of carbon, between 12.7% and 13.7% Chromium, between 0.45% and 0.75% Manganese,
between 0.20% and 0.50% silicon,
balanced iron, and
traces of Molybdenum.

2. The blade according to claim 1, further comprising:
an angle of between 95 degrees and 140 degrees formed between the cutting edge portion axis and the base portion axis.

3. The blade according to claim 1, wherein the base portion further comprises:
an inner face and an opposed outer face, the inner face and the opposed outer face of the base portion defining a thickness of between 0.07 millimeters and 0.12 millimeters.

4. The blade according to claim 1, wherein the average radius of curvature of the concave face of the bent portion is greater than 0.55 millimeters and less than 1 millimeters.

5. The blade according to claim 1, wherein the average radius of curvature of the convex face of the bent portion is greater than 0.57 millimeters and less than 1 millimeters.

6. The blade according to claim 1, wherein the average radius of curvature of the bent portion is greater than 0.535 millimeters and less than 1 millimeters.

7. The blade according to claim 1, wherein the base portion further includes a rear edge and the rear edge is serrated along a length thereof.

8. The blade according to claim 1, wherein the base portion further includes a rear edge and the rear edge is not serrated along a length thereof.

* * * * *